US012565881B2

(12) United States Patent
Martens et al.

(10) Patent No.: US 12,565,881 B2
(45) Date of Patent: Mar. 3, 2026

(54) ASSEMBLY FOR COMPRESSING GAS HAVING A HOUSING COMPRISING COOLERS IN A CENTRAL SECTION, METHOD FOR COOLING, AND USE OF SUCH AN ASSEMBLY

(71) Applicant: ATLAS COPCO AIRPOWER, NAAMLOZE VENNOOTSCHAP, Wilrijk (BE)

(72) Inventors: Kristof Adrien Laura Martens, Wilrijk (BE); Walter Josée Louis Adriaenssens, Wilrijk (BE); Steven Ray Maurits Laurent, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/691,302

(22) PCT Filed: Sep. 2, 2022

(86) PCT No.: PCT/IB2022/058258
§ 371 (c)(1),
(2) Date: Mar. 12, 2024

(87) PCT Pub. No.: WO2023/057833
PCT Pub. Date: Apr. 13, 2023

(65) Prior Publication Data

US 2024/0376878 A1 Nov. 14, 2024

(30) Foreign Application Priority Data

Oct. 4, 2021 (BE) ..... 2021/5772

(51) Int. Cl.
*F04B 39/06* (2006.01)
*F04B 23/04* (2006.01)
(Continued)

(52) U.S. Cl.
CPC ..... *F04B 39/062* (2013.01); *F04B 23/04* (2013.01); *F04B 39/066* (2013.01);
(Continued)

(58) Field of Classification Search
CPC ..... F04B 39/06–062; F04B 39/066; F04B 23/04–14; F04B 41/06; F04C 29/0007;
(Continued)

(56) References Cited

U.S. PATENT DOCUMENTS 9,494,154 B2 11/2016 Fujisawa et al.
10,816,001 B2 10/2020 Klaus et al.
(Continued)

FOREIGN PATENT DOCUMENTS

CN 102052283 A 5/2011
CN 203810783 U 9/2014
(Continued)

OTHER PUBLICATIONS

International Search Report of PCT/IB2022/058258 dated Dec. 7, 2022 [PCT/ISA/210].
(Continued)

*Primary Examiner* — Laert Dounis
(74) *Attorney, Agent, or Firm* — Sughrue Mion, PLLC

(57) ABSTRACT

A method for cooling an assembly (1) for compressing a gas containing a housing (2) having a plurality of elements for compressing gas, the method comprising:

allowing a cooling air flow (21) to flow from an environment into a first section 3 of a housing (2);

passing the cooling air flow (21) through a plurality of coolers (14, 16, 18) that are arranged in a central section (5) of the housing (2), the cooling air flow (21) being passed from the first section (3) to a second section (4) of the housing (2);

(Continued)

allowing the cooling air flow (21) to flow out from the second section (4) of the housing (2) into the environment.

21 Claims, 5 Drawing Sheets

(51) Int. Cl.

| | |
|---|---|
| ***F04B 39/12*** | (2006.01) |
| ***F04B 41/06*** | (2006.01) |
| ***F04C 11/00*** | (2006.01) |
| ***F04C 23/00*** | (2006.01) |
| ***F04C 29/00*** | (2006.01) |
| ***F04C 29/02*** | (2006.01) |
| ***F04C 29/04*** | (2006.01) |

(52) U.S. Cl.
CPC ..... *F04B 39/121* (2013.01); *F04B 41/06* (2013.01); *F04C 11/00* (2013.01); *F04C 11/001* (2013.01); *F04C 23/00* (2013.01); *F04C 29/0007* (2013.01); *F04C 29/0092* (2013.01); *F04C 29/026* (2013.01); *F04C 29/04* (2013.01); *F04C 29/042* (2013.01)

(58) Field of Classification Search
CPC ..... F04C 29/02; F04C 29/026; F04C 29/04; F04C 29/042; F04C 11/00–008; F04C 23/00–02
See application file for complete search history.

(56) References Cited

U.S. PATENT DOCUMENTS

| | | | | |
|---|---|---|---|---|
| 2008/0087027 | A1 | 4/2008 | Park et al. | |
| 2012/0286060 | A1* | 11/2012 | Korobochkin | F25C 3/04 239/14.2 |
| 2014/0303805 | A1* | 10/2014 | Zhou | F04C 28/08 700/300 |
| 2021/0017995 | A1 | 1/2021 | Dollez et al. | |
| 2021/0102540 | A1* | 4/2021 | Sadakata | F04C 29/047 |
| 2023/0135006 | A1* | 5/2023 | Carlson | F04D 25/06 417/423.5 |

FOREIGN PATENT DOCUMENTS

| | | | | | |
|---|---|---|---|---|---|
| CN | 106089659 | A | * | 11/2016 | |
| CN | 109026716 | A | | 12/2018 | |
| CN | 208996909 | U | * | 6/2019 | |
| CN | 111120277 | A | * | 5/2020 | F04B 37/12 |
| DE | 10013098 | C2 | | 6/2003 | |
| EP | 3663672 | A1 | | 6/2020 | |
| KR | 10-2004-0042055 | A | | 5/2004 | |
| TW | I527684 | B | | 4/2016 | |

OTHER PUBLICATIONS

Written Opinion of PCT/IB2022/058258 dated Dec. 7, 2022 [PCT/ISA/237].

* cited by examiner

ASSEMBLY FOR COMPRESSING GAS HAVING A HOUSING COMPRISING COOLERS IN A CENTRAL SECTION, METHOD FOR COOLING, AND USE OF SUCH AN ASSEMBLY

CROSS REFERENCE TO RELATED APPLICATIONS

This application is a National Stage of International Application No. PCT/IB2022/058258 filed on Sep. 2, 2022, claiming priority based on Belgium Patent Application No. BE2021/5772 filed on Oct. 4, 2021.

The invention relates to an assembly for compressing a gas. In particular, the invention relates to a housing having a plurality of sections, which housing is optimally constructed in terms of cooling air flow for an assembly having a plurality of elements for compressing gas, in particular liquid-injected elements such as water-injected elements and/or oil-injected elements.

In this context, "element" can mean both a compressor element and a vacuum pump element.

A primary purpose of such an assembly is to compress gas. In an oil-injected element or water-injected element, liquid, said liquid being oil or water, respectively, is added while the gas is compressed in order to lubricate parts of the element, provide a seal and/or provide cooling during the compression process and/or for further secondary reasons. By supplying the liquid, a flow coming from the element will not only contain compressed gas, but will also contain a significant amount of liquid. This liquid is separated from this flow and typically cooled in order to be supplied to the element again via a liquid injection line. The various components that make this operation possible are part of the assembly.

A housing of the assembly has various functions. On the one hand, the housing provides shielding for the elements and parts that make up the assembly. Thus, the housing provides the assembly with protection against unwanted access, against external objects and external influences, and, the other way around, the housing protects persons and animals in an environment of the housing against moving or hot element and/or parts of the assembly.

In particular if such a housing contains a plurality of elements, a suitable construction and structure of the housing is important to be able to perform maintenance and repairs. The construction of the housing and a position of the elements and parts in the housing allows an operator to perform easy or even difficult maintenance and repairs.

A final function of the housing relates to a cooling functionality. In an assembly having liquid-injected elements, cooling is typically provided for the liquid and for the compressed gas. Cooling air that has absorbed released heat is discharged by the housing in a controlled and optimal manner taking into account factors in the environment of the housing. It is often undesirable to discharge heat in a direction toward a passage for persons because these persons can experience this as extremely uncomfortable or it can even be dangerous.

It is an object of the invention to provide an assembly having an improved housing, operation and construction.

More specifically, it is an object of the invention to provide a construction of the assembly and a method for improved cooling of the assembly.

To this end, the invention provides an assembly for compressing gas, containing a housing that comprises a plurality of components, the plurality of components containing at least:

- a first liquid-injected element for compressing gas;
- a first motor for driving the first liquid-injected element;
- a second liquid-injected element for compressing gas;
- a second motor for driving the second liquid-injected element;
- a first liquid separator in fluid communication with a gas outlet of the first liquid-injected element for the gas compressed by the first liquid-injected element;
- a second liquid separator in fluid communication with a gas outlet of the second liquid-injected element for the gas compressed by the second liquid-injected element;

the plurality of components being distributed across a first section and a second section of the housing, and a central section also being provided in the housing, which central section separates the first section and the second section from each other, the central section containing:

- a first cooler for cooling a first liquid in a first liquid injection line for the first liquid-injected element in fluid communication with a liquid outlet of the first liquid separator;
- a second cooler for cooling a second liquid in a second liquid injection line for the second liquid-injected element in fluid communication with a liquid outlet of the second liquid separator.

The invention is based on the understanding that, if a plurality of liquid-injected elements are provided in one housing, it is advantageous to provide a separate liquid separator for each liquid-injected element and a separate cooler for cooling liquid separated in the respective liquid separator. This results in an assembly in which the housing has a first cooler for liquid separated in the first liquid separator and a second cooler for liquid separated in the second liquid separator, each individually being able to discharge heat to a cooling air flow. According to the invention, it appears to be particularly advantageous to place the first cooler and the second cooler in a central section of the housing. Said central section is provided between a first section and a second section of the housing and separates said first and second sections from each other. A plurality of components of the assembly, including the first liquid-injected element, the first motor, the second liquid-injected element, the second motor, the first liquid separator and the second liquid separator, are distributed across the first section and the second section. This construction appears to be optimal for cooling the components and, in particular, discharging heat from the components in the housing to an environment of the housing. Furthermore, the various parts of the assembly are easily accessible for maintenance and repairs in this construction. This housing thus offers an improved construction and operation.

A surprising advantage of the assembly relates to the flexibility of the assembly to produce a highly variable flow of compressed gas. Said flexibility is, under some circumstances, necessary in order to respond to a highly variable demand for compressed gas. Hereby, the assembly according to the invention is able to continue operating optimally and efficiently despite the highly variable flow. Hereby, it should be noted that most assemblies already known, primarily those having one element, become extremely inefficient if a variable flow of compressed gas is produced. By constructing the assembly according to the invention with two elements that are each driven by their own motor and coupled to their own liquid separator that has its own cooler for separated liquid, an assembly can be constructed on the basis of a need of a user of compressed gas, it being possible for each liquid-injected element to function optimally in the assembly. Thanks to the specific construction of the various components in the housing, the operation of the first liquid-injected element also cannot negatively influence the operation of the second liquid-injected element and/or vice versa, and the presence of a plurality of liquid-injected elements does not hinder the maintenance and repair of the plurality of components in the assembly.

The first cooler and the second cooler preferably each have one or more fans in order to force a cooling air flow through the respective cooler, each cooling air flow being provided to flow from the first section to the second section. By allowing the fans of the plurality of coolers to blow in the same direction, in particular from the first section to the second section, heat from the first and second liquid can be efficiently discharged to the environment. This is because it is not possible for a significant loop or serial circulation of cooling air to occur through a plurality of coolers. This increases the efficiency and operational reliability of the coolers, regardless of which coolers and how many coolers are active. A cooling air flow through each of the fans can also be adapted to a required cooling capacity of each cooler individually, for example by setting a speed of each of the fans individually on the basis of certain control parameters that are a measure of the required cooling capacity.

Preferably, a non-return valve is provided at a gas outlet of the first liquid separator for the gas compressed by the first liquid-injected element and at a gas outlet of the second liquid separator for the gas compressed by the second liquid-injected element.

The presence of the non-return valve, also referred to as a check valve, on the gas outlet of each liquid separator results in a complete pressure separation of the liquid circuits belonging to the two elements, which provides the possibility of starting and stopping the elements independently of each other.

The central section preferably also comprises a third cooler for cooling the gas compressed by the first liquid-injected element and second liquid-injected element in fluid communication with a gas outlet of the first liquid separator for the gas compressed by the first liquid-injected element and with a gas outlet of the second liquid separator for the gas compressed by the second liquid-injected element.

Hereby, the compressed gas can be cooled in a cooler that is shared between the first liquid-injected element and second liquid-injected element.

The third cooler preferably has one or more additional fans in order to force an additional cooling air flow through the third cooler, the additional cooling air flow being provided to flow from the first section to the second section.

By allowing the additional fans to blow in the same direction as the fans of the first cooler and the second cooler, in particular from the first section to the second section, heat from the compressed gas can be efficiently discharged to the environment. This is because it is not possible for a significant loop or serial circulation of cooling air to occur through the various coolers with the aforementioned advantages associated therewith.

The housing preferably has a gas outlet that is in fluid communication with a gas outlet of the first and second liquid separator directly or indirectly via a gas outlet of the third cooler. Providing the housing with one gas outlet simplifies use for an end user. This is because the end user does not need to take into account the fact that the housing contains a plurality of elements.

Each of the first section and second section preferably comprises at least one of the plurality of components. In other words, the plurality of components are distributed across the first section and the second section. As a result, it is not possible for either of the first and second section to be empty. The direct consequence is that the central section physically separates the plurality of components from each other.

The central section preferably also has a lead-through for at least one line selected from a gas line and a liquid line in order to put at least one of the plurality of components in the first section and at least one of the plurality of components in the second section in fluid communication with each other. If the central section is constructed with three coolers, space can easily be provided to pass lines through. In particular, if the three coolers are rectangular or substantially square, the coolers can be placed in such a way with respect to each other that a lead-through can be provided.

Preferably, the housing has at least one opening at an upper segment of the first section and/or the second section to allow cooling air to flow from an environment of the housing to and into the first section or the second section of the housing and/or vice versa. The roof element of the housing is preferably formed at least in part by a grid element in order to implement the at least one opening. If an upper segment of the housing, preferably a roof element of the housing, is provided with openings, cooling air can be sucked in and blown out at the top of the housing. As a result of this, in particular, the heated cooling air is blown out at a height that is above the height of a person in most practical situations. In other words, persons who enter the environment of the housing will not directly feel an air flow of warm cooling air that flows out of the housing. An additional advantage of this construction is that it is possible to provide air ducts for discharging the heated cooling air to the environment and/or air ducts for supplying fresh cooling air from the environment. Said air ducts can be provided above the components of the assembly and thus do not form an obstacle to access/maintenance along the sides of the assembly. In addition, sufficient space is created for the suction/inlet of the fresh cooling air and discharge/outlet of the heated cooling air so that a pressure loss as a result of a change in direction of the cooling air between the inlet and discharge openings in the roof elements of the housing is reduced to a minimum, which benefits a total energy consumption of the compressor.

Preferably, side walls of the housing are formed by side wall panels, at least part of the side wall panels being openable or removable in order to gain access to the plurality of components in the housing. By making it possible to remove and/or open side walls of the housing, access to the components in the housing can easily be provided. This significantly simplifies maintenance of the components inside the housing.

Preferably, the central section forms a partition wall between the first section and the second section, which partition wall extends across a full width and/or height of the housing, or across substantially the full width and/or height of the housing. By constructing a partition wall that extends across the full height and width of the housing, unwanted backflow of cooling air from the second section to the first section is prevented. As a result, a cooling air flow is forced from the environment to the first section of the housing, to the second section of the housing and back to the environment thanks to the construction of the housing. As a result, more optimal discharge of heat from the components in the housing to the environment is achieved.

Preferably, the first liquid in the first liquid injection line and/or the second liquid in the second liquid injection line is oil. Tests and simulations have shown that a construction such as the one described above is in particular advantageous for oil-injected compressors.

The invention also relates to a method for cooling an assembly for compressing a gas containing a housing having a plurality of elements for compressing gas, the method comprising:

allowing a cooling air flow to flow from an environment into a first section of the housing;

passing the cooling air flow through a plurality of coolers that are arranged in a central section of the housing, the cooling air flow being passed from the first section to a second section of the housing;

allowing the cooling air flow to flow out from the second section of the housing into the environment.

An assembly housing construction where the coolers are located in a central section of the housing that, on the one hand, allow the cooling air flow to enter at a first section, pass the cooling air flow from the first section to the second section through a plurality of coolers, and, on the other hand, allow the cooling air flow to exit at the second section is novel and offers many advantages. First, efficient cooling can be achieved. Second, a complex assembly of parts can be constructed in the housing that can still be easily maintained and repaired.

Preferably, at least the step of allowing the cooling air flow to flow out is carried out at an upper segment of the first section and/or second section, preferably at a roof element of the housing. Preferably, the plurality of coolers contain at least one first cooler for cooling a first liquid for a first liquid-injected element for compressing the gas and a second cooler for cooling a second liquid for a second liquid-injected element for compressing the gas, and preferably also a third cooler for cooling the compressed gas. Advantages and effects of these aspects are described above with reference to the assembly.

Finally, the invention also relates to use of an assembly according to one of the embodiments described above for supplying a compressed gas by gearing the first motor that drives the first liquid-injected element and gearing the second motor that drives the second liquid-injected element based on a demand for compressed gas. The demand can be supplied in various ways. In particular, the demand can be passively supplied, i.e., the consumption of compressed gas causes a pressure drop in a consumer network in such a way that this pressure is directly indicative of the demand for compressed gas. Alternatively, the demand can be actively supplied by forwarding data to consumers. As a further alternative, a demand can be supplied both actively and passively combined. By gearing the motors based on the demand, a variable need for compressed gas in the consumer network can be optimally supplied.

The first motor and the second motor preferably have various operating characteristics. The first motor is preferably a first type of motor having a substantially fixed rotational speed. The second motor is preferably a second type of motor having an adjustable rotational speed. Furthermore, the second type of motor preferably has a continuously variable adjustable rotational speed.

In one embodiment of the invention, the first motor is a first type of motor having a substantially fixed rotational speed and the second motor is a second type of motor having an adjustable rotational speed. A motor having a fixed rotational speed is less expensive and can be better matched to the liquid-injected element coupled thereto in order to supply compressed gas with optimal efficiency. A motor having a variable adjustable rotational speed is, for example, a motor that is coupled to a frequency regulator or voltage regulator and has an adjustable rotational speed. It is clear that neither the construction of the motor nor the manner in which the speed is controlled is the subject of this text and this aspect will therefore not be discussed further. If a liquid-injected element is coupled to a motor having an adjustable speed, the liquid-injected element not only needs to be suitable and preferably optimized for supplying compressed gas at the maximum speed, but also suitable and preferably optimized to supply compressed gas at lower speeds than the maximum speed. Such a liquid-injected element coupled to a motor having an adjustable rotational speed is therefore typically more expensive and less efficient. The major advantage, however, is that a variable amount of compressed gas can be supplied. In particular, the combination of a first motor having a fixed rotational speed in the first liquid-injected element and a second motor having an adjustable speed in the second liquid-injected element also partially combines the advantages described above.

If the first motor is a first type of motor having a substantially fixed rotational speed and the second motor is a second type of motor having an adjustable rotational speed, the first motor is preferably only switched on if the second element on its own cannot supply the demand for compressed gas.

The first motor preferably has a lower maximum operating power than the second motor. By providing the second motor having an adjustable rotational speed with greater power than the first motor having a fixed rotational speed, a "control gap" is minimized or even avoided when the first motor of the first liquid-injected element is switched on. A control gap can arise if approximately half of a combined maximum deliverable flow rate of compressed gas is demanded, in particular if the first motor having a fixed rotational speed is switched on while the second motor having an adjustable rotational speed is geared down or switched off. Tests have shown that if the first motor having a fixed rotational speed is switched on while the second motor with the same power having an adjustable rotational speed is brought to its minimum possible operating speed, the combination of the first motor with the second motor at a minimum operating speed will typically supply a higher flow rate of compressed gas than if only the second motor runs at maximum operating speed, such that a "control gap" arises with respect to a flow rate of compressed gas supplied by the assembly when switching from a regime in which only the second motor runs at maximum operating speed to a regime in which the first motor is switched on in addition to the second motor and vice versa. In other words, the control gap is an interval of flow rates of compressed gas between the maximum flow rate of compressed gas that can be supplied by the second liquid-injected element having the second motor with an adjustable rotational speed on its own and the minimum flow rate of compressed gas that can be supplied by the first liquid-injected element having the first motor with a fixed rotational speed. The assembly cannot precisely supply flow rates of compressed gas in this control gap. Yet, to approximately address a demanded flow rate of compressed gas that is in such a control gap, the first liquid-injected element having the first motor with a fixed rotational speed should run iteratively in an alternating manner between a loaded and unloaded state. This is very disadvantageous in terms of energy because allowing the first liquid-injected element to run in an unloaded state requires operating power without compressed gas being supplied by the first liquid-injected element. A decrease in the maximum operating power of the first motor having a fixed rotational speed also results in a decrease in the minimum flow rate of compressed gas that can be supplied by the first liquid-injected element having the first motor with a fixed rotational speed on its own. As a result, the control gap becomes smaller or is even completely eliminated. On the other hand, a decrease in the maximum operating power of the first motor having a fixed rotational speed also means a decrease in the maximum flow rate of compressed gas that can be supplied by a combination of the first and second liquid-injected elements of the assembly. Tests have shown that the maximum power of the first motor having a fixed rotational speed is preferably more than 60%, more preferably more than 70% of the maximum power of the second motor having an adjustable rotational speed. Furthermore, the maximum power of the first motor having a fixed rotational speed is preferably less than 90%, more preferably less than 80% of the maximum power of the second motor having an adjustable rotational speed. This optimizes the maximum deliverable flow rate of compressed gas while minimizing disadvantageous effects of a potential control gap.

The invention will be explained in more detail below using the embodiment examples depicted in the drawings.

Figure 1:
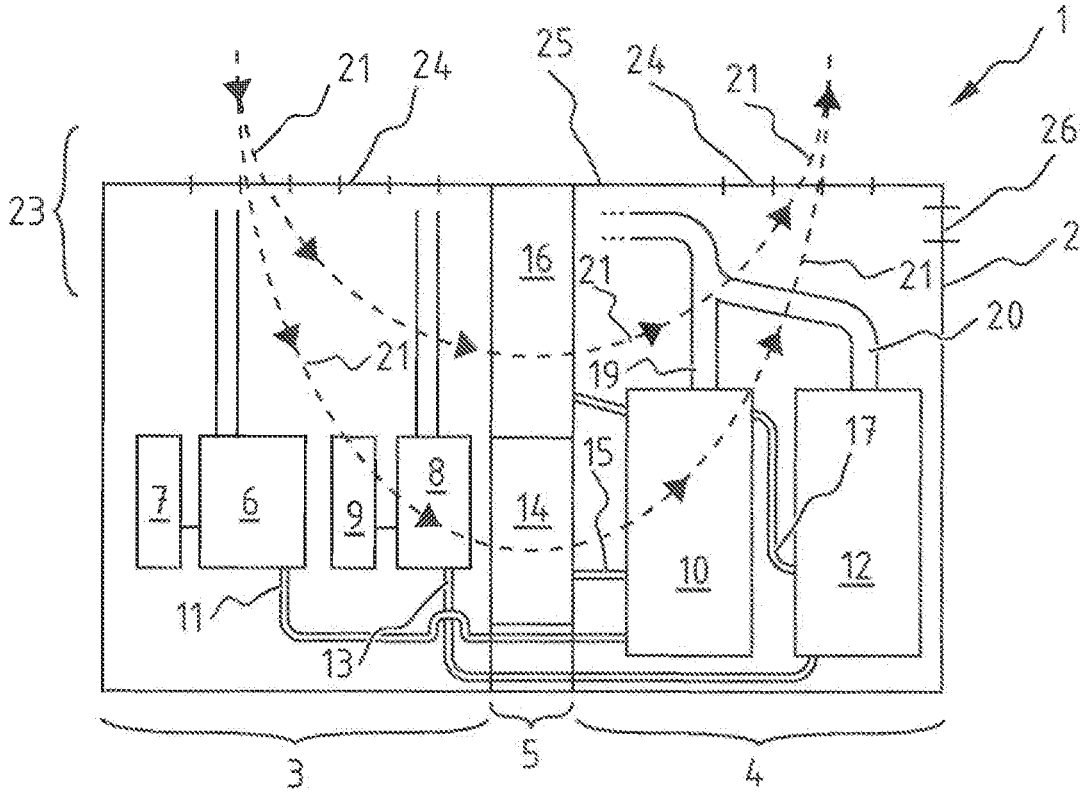
FIG. 1 is a schematic side view of an assembly according to an embodiment of the invention.

In the drawings, the same reference sign is assigned to the same or comparable components of the assembly.

The primary purpose of the assembly 1 is to supply compressed gas. To this end, each liquid-injected element 6, 8 in the assembly 1 is primarily provided for compressing the gas to be compressed. By supplying a liquid such as oil or water in the element 6, 8, a flow coming from the element 6, 8 will not only contain compressed gas, but will also contain a significant amount of liquid. By putting a gas outlet of each element 6, 8 in fluid communication with an inlet of a liquid separator 10, 12 that, for example, contains a cyclone separator, most of the liquid can be separated from the flow. This offers the further possibility of returning the separated liquid to the element 6, 8 so that a substantially closed circuit is created in which liquid can be reused. In practice, a liquid flow and, optionally, a gas flow coming from a liquid separator are cooled by a liquid cooler and a gas cooler, respectively. Preferably, a non-return valve is provided downstream of each liquid separator 10, 12. In particular, a minimum pressure valve is placed in the proximity of a gas outlet of each liquid separator 10, 12. This valve ensures that no compressed gas flows back from lines downstream of the liquid separator 10, 12 to the liquid separator 10, 12. Indeed, this ensures that the liquid circuits are completely separated from each other in terms of pressure, and that the two elements 6, 8 can thus operate independently of each other. A further non-return valve is preferably placed near a gas inlet of each liquid-injected element 6, 8 to ensure that, if the element 6, 8 stops working, it does not reverse due to the compressed gas still present in the associated liquid separator 10, 12.

FIG. 1 shows a construction of an assembly 1 according to one embodiment of the invention. The assembly 1 contains a plurality of components for producing compressed gas, which plurality of components are assembled together in a housing 2. The housing 2 has a first section 3 and a second section 4. The first section 3 is separated from the second section 4 by a central section 5. The central section 5 divides the housing 2 into two parts, not necessarily two equal parts. The plurality of components are distributed across the various sections. An embodiment example is described below.

In FIG. 1, the assembly 1 contains a plurality of element 6 and 8 in one housing 2. The advantage of a plurality of elements 6 and 8 in one housing 2 is that a greater flow fluctuation of compressed gas can be accommodated by the assembly 1 having a plurality of elements 6 and 8 in comparison with a single element. Furthermore, the efficiency of making compressed gas with a varying flow rate is higher if a plurality of elements 6 and 8 are provided. The figures show embodiments with two elements 6 and 8. It is clear that the same principles of the invention can be applied to assemblies 1 having three or more elements. The invention is not limited to an assembly 1 having only two elements 6 and 8.

The elements 6 and 8 can be the same elements or different elements. The motors 7 and 9 that drive the elements 6 and 8, respectively, can be the same motors or different motors and/or can be controlled in the same manner or in different manners. In one embodiment, the two motors 7 and 9 are both fixed-speed motors. Alternatively, the two motors 7 and 9 are pole changing motors due to the presence of at least two different coils, as a result of which they can run at at least two fixed speeds. As a further alternative, the two motors 7 and 9 are both variable-speed motors, which are typically controlled by a frequency regulator. As an even further alternative, one of the two motors 7 and 9 is a fixed-speed motor or pole changing motor and a second of the two motors 7 and 9 is a variable-speed motor. The invention is not limited to motors having the same power. The two motors 7 and 9 can thus also have a mutually different power, which is additionally favorable in connection with regulation in the case of a varying demand for compressed gas. For example, if motor 7 is a fixed-speed motor and motor 9 is a variable-speed motor, it is favorable to choose a power of the variable-speed motor that is greater than a power of the fixed-speed motor so that no control gap arises when the fixed-speed motor is switched on and off. For the sake of clarity, a fixed-speed motor is a motor of a first type having a substantially fixed rotational speed, and a variable-speed motor is a motor of a second type having a variable adjustable rotational speed. In the embodiment shown, the two elements 6 and 8 and the two motors 7 and 9 are provided in the first section 3 of the housing 2.

Each element 6 and 8 is connected to a liquid separator 10 and 12. As explained above, the element 6, 8 is primarily provided for supplying compressed gas. To this end, each element 6 and 8 has a gas outlet 11 and 13, respectively. The flow coming from said gas outlet 11 and 13 contains not only compressed gas but also a significant amount of liquid. The liquid separators 10 and 12 are in fluid communication with the gas outlets 11 and 13, respectively, in order to separate the liquid from the flow.

Each liquid separator 10 and 12 can be constructed and optimized for the connected element 6, 8. The liquid separators 10 and 12 can thereby be constructed and/or dimensioned differently. Each liquid separator 10 and 12 preferably contains both a cyclone separator and one or more liquid filter elements. Each liquid separator 10 and 12 has a liquid outlet 15 and 17, respectively, and a gas outlet 19, 20, respectively. The liquid from the liquid outlets 15 and 17 is returned to the element 6, 8 via a respective cooler 14, 16. The compressed gas coming from the two gas outlets 19 and 20, after having passed through a minimum pressure valve having an integrated check valve, is combined and brought to a cooler 18 (not shown in FIG. 1) before feeding the compressed gas to a gas outlet 26 of the housing 2. The cooling air supply or exhaust of each of the first cooler 14, second cooler 16 and third cooler 18 (not shown in FIG. 1) can be controlled individually based on a cooling need for the respective cooler 14, 16, 18 so that the assembly 1 can operate optimally and efficiently.

Figure 2:
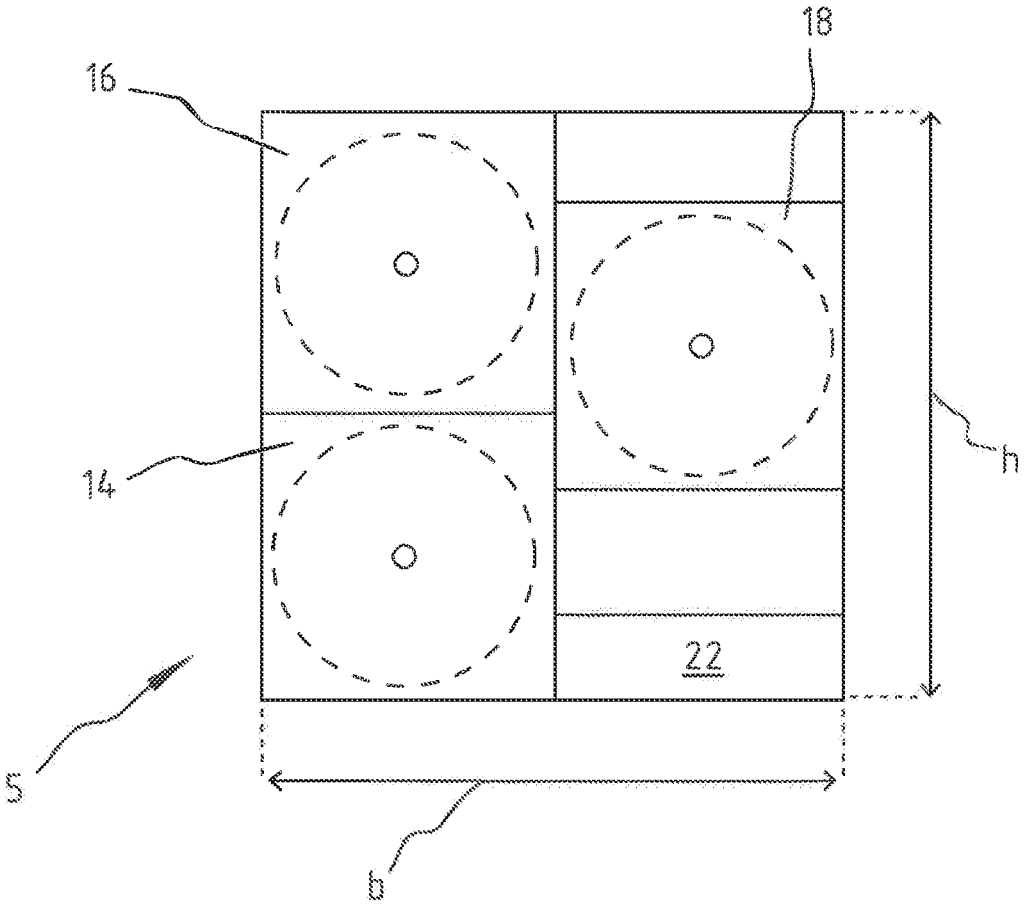
FIG. 2 is a cross section of the central section of the assembly from FIG. 1.

The first cooler 14, second cooler 16 and third cooler 18 are provided in the central section 5. FIG. 2 shows a cross section of the central section 5 and shows how the first cooler 14, second cooler 16 and third cooler 18 can be placed with respect to one another. Each cooler 14, 16, 18 is formed by a heat exchanger having slats for discharging heat to the cooling air. Hereby, each cooler 14, 16, 18 has one or more fans to force cooling air through the heat exchanger. The central section 5 forms one large cooling surface composed of the plurality of coolers 14, 16, 18, each cooler 14, 16, 18 having one or more fans. The fans are located substantially in one plane in the central section 5 and are provided to suck in and blow away cooling air in the same direction. In the embodiment shown, sucking in and blowing away cooling air is shown with a cooling air flow 21. In particular, the fans are provided to blow cooling air from the first section 3 to the second section 4. Because the plurality of fans are located next to each other and provided to suck in and blow away the cooling air in the same direction, an optimal whole is achieved in terms of cooling air flow in the housing 2 in which the various coolers 14, 16, 18 cannot influence each other in a significantly negative way.

FIG. 1 also shows that a roof element 25 of each of the first section 3 and second section 4 of the housing 2 is provided with openings 24, for example formed by a grid in order to allow the cooling air flow 21 in and out of the relevant section 3, 4. This allows to draw in cooling air from above in the first section 3. This allows to blow away heated cooling air at the top in the second section 4. As a result, a person located somewhere around the housing 2 will not experience any direct burden or significant nuisance from the heated cooling air flow 21. A person skilled in the art understands that this effect is in particular relevant for blowing heated cooling air and that a position of the suction openings is less relevant. A person skilled in the art also understands that the openings 24 do not necessarily have to be placed in the roof element 25, but that the openings 24 can be provided in an upper segment 23 of the housing 2. As a further alternative, a predetermined wall panel of the housing 2 can be provided with the openings 24 in order to facilitate the cooling air flow 21. When selecting the wall panel, an environment where the housing 2 is positioned can be taken into account.

FIG. 2 shows a cross section of the housing 2 at the central section 5. FIG. 2 shows that a cooler assembly of the first cooler 14, second cooler 16 and the third cooler 18 substantially forms a complete height h and width b of the housing 2. The central section 5 thus forms a physical separation between the first section 3 and second section 4 of the housing 2. The figure shows an arrangement in which the first and second coolers 14 and 16 are placed one above the other, thus defining the height h of the housing. Alternatively, the first and second coolers 14 and 16 can be placed next to each other so that they define the width b of the housing 2. In the embodiment shown, the third cooler 18 is placed next to the first and second coolers 14 and 16 so that they thus together define the width b of the housing 2. The third cooler 18 is placed at a distance from the upper side and at a distance from the underside of the housing 2. Alternatively, the third cooler 18 can also be placed completely at the top or bottom of the housing 2. The illustrated position of the third cooler 18 allows connections to the third cooler 18 and connections to the upper second cooler 16 to be implemented in a space above the third cooler 18. A space below the third cooler 18 can also be used to implement connections to the third cooler 18 and to the lower first cooler 14 and can also be used as a lead-through for lines. The plurality of components in the first section 3 and second section 4 of the housing 2 are placed in fluid communication with each other fully operationally. To this end, lines, including gas lines, liquid lines and electrical lines, are laid between the various components in order to make the operational functioning as optimal as possible. The lead-through is indicated in FIG. 2 by reference sign 22.

Figure 3:
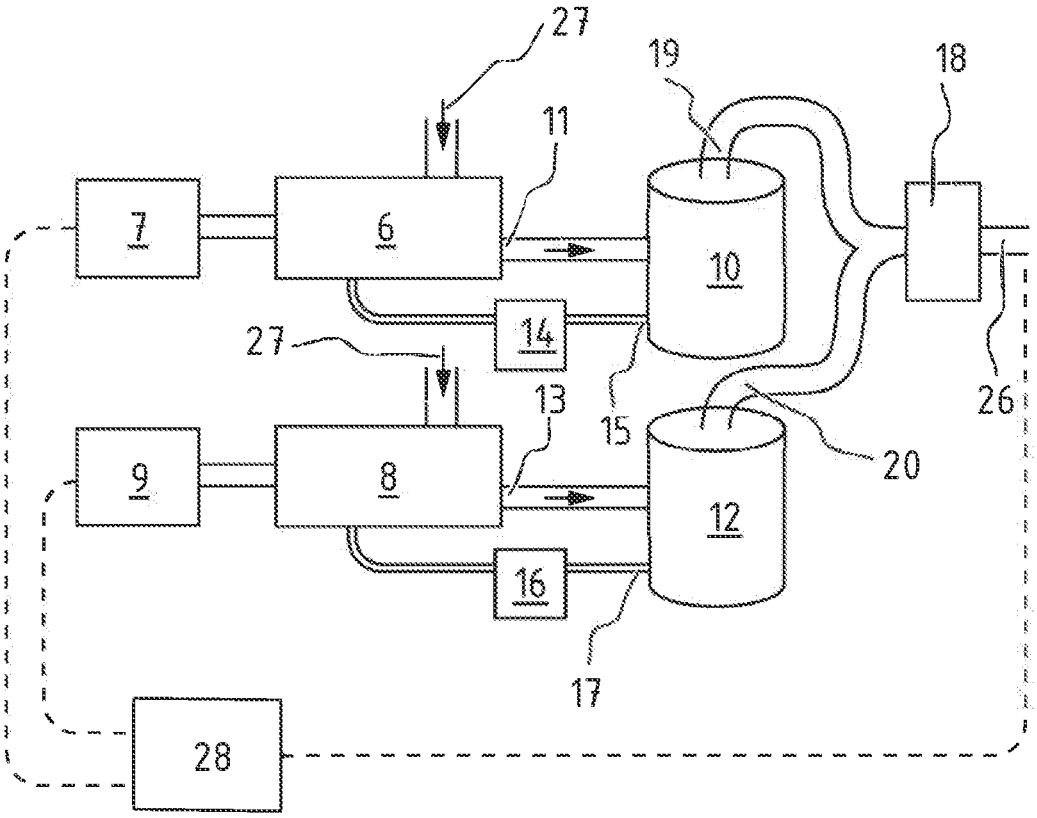
FIG. 3 is a flow chart of an assembly according to an embodiment of the invention.

FIG. 3 shows a schematic construction of the assembly 1 from which the operation and interrelationship of the various components is clear. FIG. 3 shows how a first element 6 is driven by a first motor 7. The first element 6 draws gas from a gas inlet 27. If a special gas, for example nitrogen or oxygen, has to be compressed, the gas inlet 27 is connected to a gas storage tank or to a gas production facility. The element 6 also has a liquid inlet for injecting a liquid for cooling, lubricating and/or sealing the element 6, and is provided to compress the gas and the liquid to a first gas outlet 11. Said gas outlet 11 is in fluid communication with a liquid separator 10 because not only compressed gas but also a significant amount of liquid comes out of the gas outlet 11. The liquid separator 10 separates the flow of the gas outlet 11 into a gas flow and a liquid flow. The liquid flow comes out of the liquid outlet 15 and is returned via the first cooler 14 to the element 6 so as to form a closed liquid circuit. The gas flow comes out of the gas outlet 19 of the liquid separator 10 and is fed to the gas outlet 26 of the housing 2, optionally via the third cooler 18.

FIG. 3 further shows how a second element 8 is driven by a second motor 9. The second element 8 draws gas from a gas inlet 27. If a special gas, for example nitrogen or oxygen have to be compressed, the gas inlet 27 is connected to a gas storage tank or to a gas production facility. The element 8 also has a liquid inlet for injecting a liquid for cooling, lubricating and/or sealing the element 8, and is provided to compress the gas and the liquid to a second gas outlet 13. Said gas outlet 13 is connected to a liquid separator 12 because not only compressed gas but also a significant amount of liquid comes out of the gas outlet 13. The liquid separator 12 separates the flow of the gas outlet 13 into a gas flow and a liquid flow. The liquid flow comes out of the liquid outlet 17 and is returned via the second cooler 16 to the element 8 so as to form a closed liquid circuit. The gas flow comes out of the gas outlet 20 of the liquid separator 12 and is fed to the gas outlet 26 of the housing 2, optionally via the third cooler 18.

FIG. 3 shows how the gas outlet 19 of the first liquid separator 10 and the gas outlet 20 of the second liquid separator 12 are brought together before going to the third cooler 18. The two gas flows out of the liquid separators 10, 12 are thus cooled by one cooler 18. Tests and simulations have shown that this does not entail a significant decrease in efficiency. FIG. 3 also shows how a controller 28 is provided to control the first motor 7 and second motor 9 based on a demand for compressed gas. The controller 28 can thus efficiently control the two elements 6 and 8 separately and/or together to respond to a demand for compressed gas. The controller 28 can also control a cooling air flow rate of the fans that are located in the central section 5.

Figure 4:
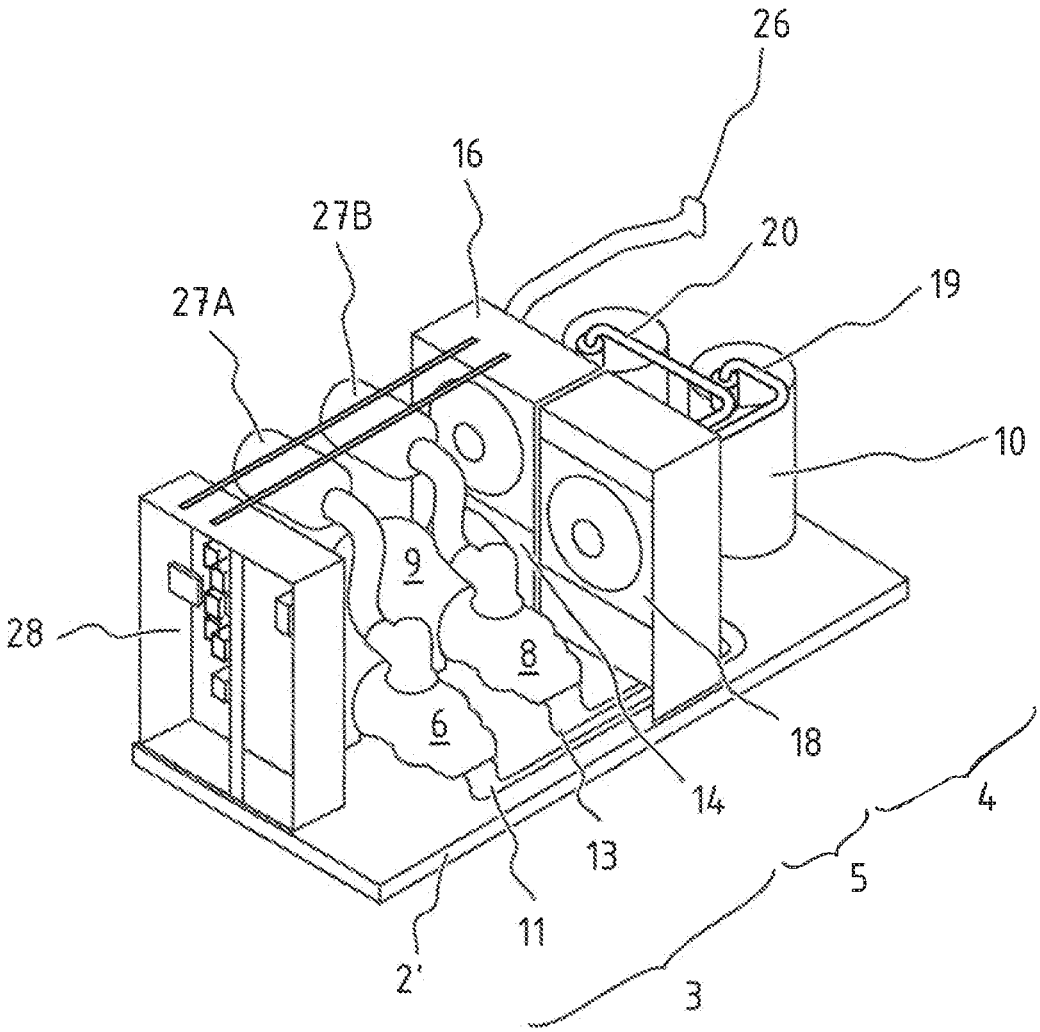
FIG. 4 is a first perspective view of an assembly according to a practical embodiment of the invention.
Figure 5:
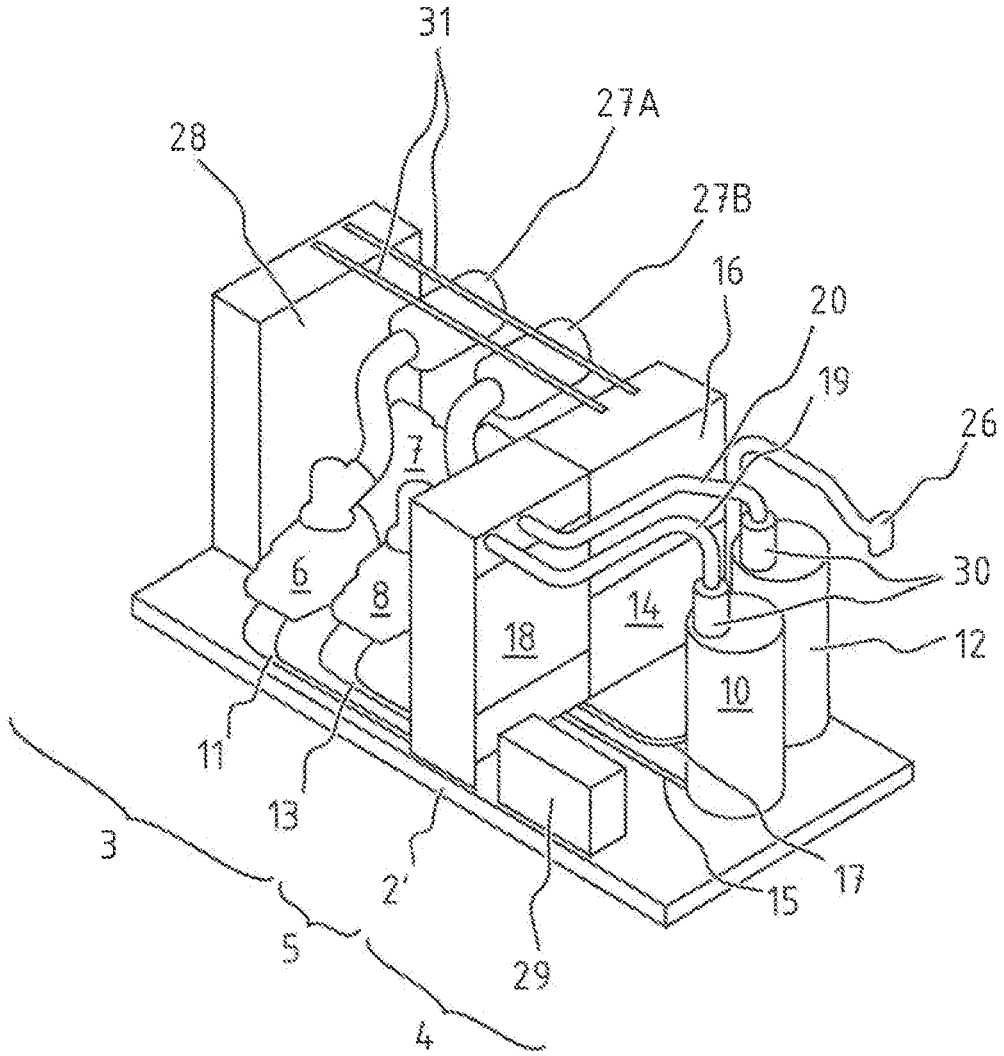
FIG. 5 is a second perspective view of the assembly from FIG. 4.

FIGS. 4 and 5 show different perspective views of a more practical embodiment of the assembly 1. The housing 2 is hereby shown as being open, in particular without side walls and roof walls. FIGS. 4 and 5 only show a bottom 2' of the housing 2. The first section 3, second section 4 and central section 5 are also indicated in FIGS. 4 and 5. Hereby, the first section 3 is larger than the second section 4. A first element 6 and a second element 8 are placed in the first section 3. Said elements 6 and 8 are placed next to each other in the housing 2 and preferably provided on rails that extend in the transverse direction of the housing 2. The transverse direction is equal to the direction of the width b of the central section 5. As a result, if a side wall of the housing 2 is partially or fully opened, an element 6 or 8 can be pushed out of or into the housing 2 via the opened side wall and be installed on and/or removed from the rails. This construction simplifies maintenance and repairs. The motors 7 and 9 can also be installed on rails in order to be installed and/or removed via the opposite side wall.

FIGS. 4 and 5 also show how the first section 3 contains a control cabinet that can, for example, contain the controller 28 from FIG. 3. The control cabinet can also contain devices and cabling for connecting and controlling the different parts of the assembly 1. The control cabinet can read out sensors, contain switching modules for motors, for example a frequency regulator, contain protection devices, etc.

FIGS. 4 and 5 show how the inlet of the elements 6 and 8 can contain an inlet filter 27A and 27B. The inlet filters 27A and 27B are positioned near a roof element of the housing 2, which roof element contains the openings to allow the cooling air flow 21 into the housing 2. In the embodiment shown, a rail or support structure is provided between the control cabinet and the central section 5 from which the inlet filters 27A and 27B can be hung. This simplifies the installation of the assembly 1.

FIGS. 4 and 5 show how the central section 5 physically separates the first section 3 from the second section 4 into a so-called cold compartment with sucked in cooling air and a warm compartment with heated cooling air. In other words, the central section 5 forms a partition wall composed of a plurality of modules that are located between the first section 3 and the second section 4. The central section 5 contains the first cooler 14, the second cooler 16, and optionally the third cooler 18 and at least one lead-through 22. In the embodiment shown, the lead-through 22 is provided under the third cooler 18. Lines, tubes and cables can be placed through the lead-through 22 in order to operationally connect components and parts in the first section 3 to components and parts in the second section 4. In the figures shown, the gas outlets 11 and 13 of the elements 6 and 8 are operationally in fluid communication with the liquid separators 10 and 12.

The liquid separators 10 and 12 are placed in the second section 4. Each liquid separator 10 and 12 in the embodiment shown has a cyclone separator and is provided with an extra liquid filter, indicated by reference sign 30. A person skilled in the art will understand that different kinds and types of liquid separators can be used and/or combined based on need and circumstances. FIG. 5 also schematically shows a component 29 that can contain different liquid connections, liquid filters, air vents, pressure regulators, temperature control valves and/or other parts.

FIGS. 4 and 5 also show how a gas outlet 26 is provided at a wall of the housing 2 in order to supply the compressed gas outside the housing 2. A user can connect to the gas outlet 26 in order to use the compressed gas that is generated inside the housing 2. The components inside the housing 2 are also provided to respond to the demand for compressed gas, in particular to produce the compressed gas that is taken from the gas outlet 26.

Each of the coolers 14, 16, and 18 is accessible from a side of the housing 2. This allows, for example, filters to be replaced by sliding a filter element in and out, transversely to the housing 2, to and from the outside of the housing 2. In addition, the coolers 14, 16, 18 themselves can also be slid laterally, transversely to the housing 2, on rails, for example, to chemically clean them. Because the coolers 14, 16 and 18 are provided in the central zone 5, the first zone 3 and the second zone 4 remain maximally accessible to carry out work, replacements and/or maintenance for the various parts of the assembly 1. FIGS. 4 and 5 show that the construction of the housing 2 having the first section 3 and the second section 4 is open with a lot of space around the various parts. This facilitates the installation and maintenance of the assembly 1.

The figures also illustrate how the construction of the housing 2 improves the operation of the assembly 1. In particular, FIG. 1 shows how cooling air flows through the housing 2. Cooling air flows in at the location of a roof element of the first section 3. The cooling air is blown to the second section 4 via coolers 14, 16, 18 that are placed in the central section 5. Here, the cooling air is typically heated as a result of a heat exchange at the coolers 14, 16, 18. The heated cooling air is discharged at the location of a roof element of the second section 4.

On the basis of the above description, it will be understood by a skilled professional that the invention can be implemented in different ways and based on different principles. In addition, the invention is not limited to the embodiments described above. The embodiments described above, as well as the figures, are merely illustrative and serve only to increase the understanding of the invention. The invention will therefore not be limited to the embodiments described herein, but is defined in the claims.

The invention claimed is:

1. An assembly for compressing a gas, containing a housing that comprises a plurality of components, the plurality of components containing at least:

a first liquid-injected element for compressing gas;

a first motor for driving the first liquid-injected element;

a second liquid-injected element for compressing gas;

a second motor for driving the second liquid-injected element;

a first liquid separator in fluid communication with a gas outlet of the first liquid-injected element for the gas compressed by the first liquid-injected element;

a second liquid separator in fluid communication with a gas outlet of the second liquid-injected element for the gas compressed by the second liquid-injected element;

the plurality of components being distributed across a first section and a second section of the housing, and a central section also being provided in the housing, which central section separates the first section and the second section from each other, the central section containing:

a first cooler for cooling a first liquid in a first liquid injection line for the first liquid-injected element in fluid communication with a liquid outlet of the first liquid separator;

a second cooler for cooling a second liquid in a second liquid injection line for the second liquid-injected element in fluid communication with a liquid outlet of the second liquid separator, wherein the first cooler and the second cooler each have one or more fans to force a cooling air flow through the first cooler and second cooler in a same direction, each cooling air flow being provided to flow from the first section to the second section.

2. The assembly according to claim 1, a non-return valve being provided at a gas outlet of the first liquid separator for the gas compressed by the first liquid-injected element and at a gas outlet of the second liquid separator for the gas compressed by the second liquid-injected element.

3. The assembly according to claim 2, the central section also containing a third cooler for cooling the gas compressed by the first liquid-injected element and second liquid-injected element in fluid communication with the gas outlet of the first liquid separator and with the gas outlet of the second liquid separator.

4. The assembly according to claim 3, the third cooler having one or more additional fans in order to force an additional cooling air flow through the third cooler, the additional cooling air flow being provided to flow from the first section to the second section.

5. The assembly according to claim 3, the housing having a gas outlet that is in fluid communication with a gas outlet of the third cooler.

6. The assembly according to claim 1, each of the first section and second section comprising at least one of the plurality of components.

7. The assembly according to claim 6, the central section also having a lead-through for at least one line selected from a gas line and a liquid line in order to place at least one of the plurality of components in the first section and at least one of the plurality of components in the second section in fluid communication with each other.

8. The assembly according to claim 1, the housing having at least one opening at an upper segment of the first section and/or the second section to allow cooling air to flow from an environment of the housing to and into the first section or the second section of the housing and/or vice versa.

9. The assembly according to claim 8, a roof element of the housing being formed at least in part by a grid element in order to implement the at least one opening.

10. The assembly according to claim 1, side walls of the housing being formed by side wall panels, at least part of the side wall panels being openable or removable in order to gain access to the plurality of components in the housing.

11. The assembly according to claim 1, the central section forming a partition wall between the first section and the second section, which partition wall extends across a full width (b) and/or height (h), or across substantially the full width (b) and/or height (h) of the housing.

12. The assembly according to claim 1, the first liquid in the first liquid injection line and/or the second liquid in the second liquid injection line being oil.

13. The assembly according to claim 1, wherein the assembly is configured to supply compressed gas by gearing the first motor that drives the first liquid-injected element and gearing the second motor that drives the second liquid-injected element based on a demand for compressed gas.

14. The assembly according to claim 13, wherein the first motor and the second motor operate under varying operating characteristics.

15. The assembly according to claim 14, wherein the first motor is a first type of motor having a substantially fixed rotational speed.

16. The assembly according to claim 14, wherein the second motor is a second type of motor having a continuously variable adjustable rotational speed.

17. The assembly according to claim 15, wherein the first motor is configured to only being switched on if the second liquid-injected element on its own cannot supply the demand for compressed gas.

18. The assembly according to claim 17, wherein the first motor has a lower maximum operating power than the second motor.

19. A method for cooling an assembly for compressing a gas containing a housing having a plurality of elements for compressing gas, the method comprising:

allowing a cooling air flow to flow from an environment into a first section of the housing;

passing the cooling air flow through a plurality of coolers that are arranged in a central section of the housing the separates the first section of the housing and a second section of the housing from each other, the cooling air flow being passed from the first section to the second section of the housing by way of one or more fans of the plurality of coolers forcing the cooling air flow to flow through the plurality of coolers in a same direction;

allowing the cooling air flow to flow out from the second section of the housing into the environment.

20. The method according to claim 19, wherein the allowing the cooling air flow to flow out comprises allowing the cooling air flow to be carried out at an upper segment of the first section and/or the second section at a roof element of the housing.

21. The method according to claim 19, wherein the plurality of coolers contain at least one first cooler for cooling a first liquid for a first liquid-injected element for compressing the gas and a second cooler for cooling a second liquid for a second liquid-injected element for compressing the gas, and a third cooler for cooling the compressed gas.

* * * * *